US008816791B2

(12) United States Patent
Nguyen et al.

(10) Patent No.: US 8,816,791 B2
(45) Date of Patent: Aug. 26, 2014

(54) SYSTEMS AND METHODS OF A RECTANGULAR-TO-CIRCULAR WAVEGUIDE TRANSITION

(75) Inventors: Cuong Nguyen, San Jose, CA (US); David C. M. Pham, Fremont, CA (US); Jayesh Nath, Santa Clara, CA (US); John Ruiz, San Jose, CA (US); Thuan Huynh, San Jose, CA (US)

(73) Assignee: Aviat U.S., Inc., Santa Clara, CA (US)

( * ) Notice: Subject to any disclaimer, the term of this patent is extended or adjusted under 35 U.S.C. 154(b) by 286 days.

(21) Appl. No.: 13/221,781

(22) Filed: Aug. 30, 2011

(65) Prior Publication Data

US 2012/0075040 A1 Mar. 29, 2012

Related U.S. Application Data

(60) Provisional application No. 61/387,421, filed on Sep. 28, 2010.

(51) Int. Cl.

| | |
|---|---|
| ***H01P 1/16*** | (2006.01) |
| ***H01P 1/162*** | (2006.01) |
| ***H01P 5/08*** | (2006.01) |

(52) U.S. Cl.

CPC ..... *H01P 1/162* (2013.01); *H01P 5/082* (2013.01)

USPC ..... 333/21 R; 333/251

(58) Field of Classification Search

USPC ..... 333/21 R, 35, 249, 251

See application file for complete search history.

(56) References Cited

U.S. PATENT DOCUMENTS

| | | | | |
|---|---|---|---|---|
| 3,349,346 | A | 10/1967 | Enderby | |
| 3,611,246 | A * | 10/1971 | Booe | 338/308 |
| 5,886,588 | A | 3/1999 | Schneider | |
| 6,583,693 | B2 | 6/2003 | Paynter et al. | |
| 7,050,765 | B2 | 5/2006 | Ammar et al. | |
| 7,420,434 | B2 * | 9/2008 | Hoover | 333/21 R |
| 7,640,951 | B2 * | 1/2010 | Fujimura et al. | 139/420 R |
| 7,745,912 | B2 | 6/2010 | Sir | |
| 2008/0136565 | A1 | 6/2008 | Paynter | |
| 2009/0217818 | A1 | 9/2009 | Gonze et al. | |

OTHER PUBLICATIONS

International Application No. PCT/US2011/053060, International Search Report and Written Opinion mailed Jan. 17, 2012.

* cited by examiner

*Primary Examiner* — Robert Pascal
*Assistant Examiner* — Kimberly Glenn
(74) *Attorney, Agent, or Firm* — Sheppard, Mullin, Richter & Hampton LLP

(57) ABSTRACT

Systems and methods for a filtering wave energy using a rectangular-to-circular waveguide transition are discussed herein. An exemplary system comprises a rectangular-to-circular waveguide transition and a filter card. The rectangular-to-circular waveguide transition may include a front section and a back section opposite the front section, the rectangular-to-circular waveguide transition defining a circular hole extending from the front section of the rectangular-to-circular waveguide transition through the back section, the rectangular-to-circular waveguide transition further having a first arcuate region on the face of the transition, the first arcuate region defining a first cavity extending from the circular hole through the first arcuate region, the rectangular-to-circular waveguide transition also having a second arcuate region defining a second cavity opposite the first cavity, the second cavity extending from the circular hole through the second arcuate region. The filter card may be configured to be placed across the circular hole of the rectangular-to-circular waveguide transition.

18 Claims, 9 Drawing Sheets

Frequency response of circular-to-rectangular waveguide transition WITH high-order mode suppressor.

SYSTEMS AND METHODS OF A RECTANGULAR-TO-CIRCULAR WAVEGUIDE TRANSITION

CROSS-REFERENCE TO RELATED APPLICATIONS

The present application claims benefit of U.S. Provisional Patent Application No. 61/387,421 filed Sep. 28, 2010, and entitled "High-Order Mode Suppressor for Compact Rectangular-to-Circular Waveguide Transition in Microwave and Millimeter-Wave Radios" which is incorporated by reference herein.

BACKGROUND

1. Field of the Invention

The present invention(s) generally relate to waveguides. More particularly, the invention(s) relate to systems and methods of a rectangular-to-circular waveguide transition.

2. Description of Related Art

As microwave communication has become increasingly common to support a growing wireless communication network, improving quality, efficiency, and speed of communication is becoming essential.

One problem associated with circular waveguides is that while the waveguide traditionally provide a TE11 signal with very low loss, the waveguide also supports many higher-order modes such as TE01, TE21, TE31, TE41, TM01, TM02, TM11, TM31, etc. These higher-order modes can cause resonances depending upon length of the circular waveguide. These resonances may create unexpected loss of the signal.

Further, component mismatch within a network may cause signal loss due to reflections and resonances of higher modes. In microwave communication systems, it is not uncommon for antennas to use circular waveguides and processing equipment to use rectangular waveguides. A rectangular-to-circular waveguide transition may be used to provide the signal to and from the antenna, however, if there is mechanical mismatch between the transition and the antenna or the processing equipment, resonances may occur.

SUMMARY OF THE INVENTION

Systems and methods for a filtering wave energy using a rectangular-to-circular waveguide transition are discussed herein. In various embodiments, an exemplary system comprises a rectangular-to-circular waveguide transition and a filter card. The rectangular-to-circular waveguide transition may include a front section and a back section opposite the front section, the rectangular-to-circular waveguide transition defining a circular hole extending from the front section through the back section, the rectangular-to-circular waveguide transition further having a first arcuate region on the face of the transition, the first arcuate region defining a first cavity extending from the circular hole through the first arcuate region, the rectangular-to-circular waveguide transition also having a second arcuate region defining a second cavity opposite the first cavity, the second cavity extending from the circular hole through the second arcuate region. The filter card may be configured to be placed across the circular hole of the rectangular-to-circular waveguide transition.

The filter card may extend vertically across the circular hole of the rectangular-to-circular waveguide transition. Further, the first arcuate region may further define a first recess within the first cavity and the second arcuate region may further define a second recess within the second cavity. The filter card may comprise tabs along the first and second edges, wherein the tabs limit a position within the recesses of the first and second edges of the filter card. In some embodiments, the first and second recesses are configured to receive a first and second edge of the filter card to position the filter card across the circular hole.

The filter card may be configured to suppress high-order modes, and/or attenuates at least some wave energy. The filter card may comprise a substrate of woven glass cloth impregnated with thermosetting resin and/or a resistance film comprising a nickel chromium alloy.

In various embodiments, the system further comprises an antenna and an outdoor unit (ODU) whereby signals from the antenna are received by the ODU via the rectangular-to-circular waveguide transition. The rectangular-to-circular waveguide transition may be compact.

An exemplary method may comprise receiving, by a rectangular-to-circular waveguide transition, wave energy from an antenna, the rectangular-to-circular waveguide transition including a front section and a back section opposite the front section, the rectangular-to-circular waveguide transition defining a circular hole extending from the front section at through the back section, the rectangular-to-circular waveguide transition further having a first arcuate region on the face of the transition, the first arcuate region defining a first cavity extending from the circular hole through the first arcuate region, the rectangular-to-circular waveguide transition also having a second arcuate region defining a second cavity opposite the first cavity, the second cavity extending from the circular hole through the second arcuate region. Further the method may comprise filtering the wave energy from the antenna with a filter card configured to be placed across the circular hole of the rectangular-to-circular waveguide transition.

Another exemplary system may comprise a rectangular-to-circular waveguide transition and a filtering means for filtering wave energy. The rectangular-to-circular waveguide transition may include a front section and a back section opposite the front section, the rectangular-to-circular waveguide transition defining a circular hole extending from the front section through the back section, the rectangular-to-circular waveguide transition further having a first arcuate region on the face of the transition, the first arcuate region defining a first cavity extending from the circular hole through the first arcuate region, the rectangular-to-circular waveguide transition also having a second arcuate region defining a second cavity opposite the first cavity, the second cavity extending from the circular hole through the second arcuate region. The filtering means for filtering wave energy may be configured to be placed across the circular hole of the rectangular-to-circular waveguide transition.

DETAILED DESCRIPTION OF THE INVENTION

Figure 1:
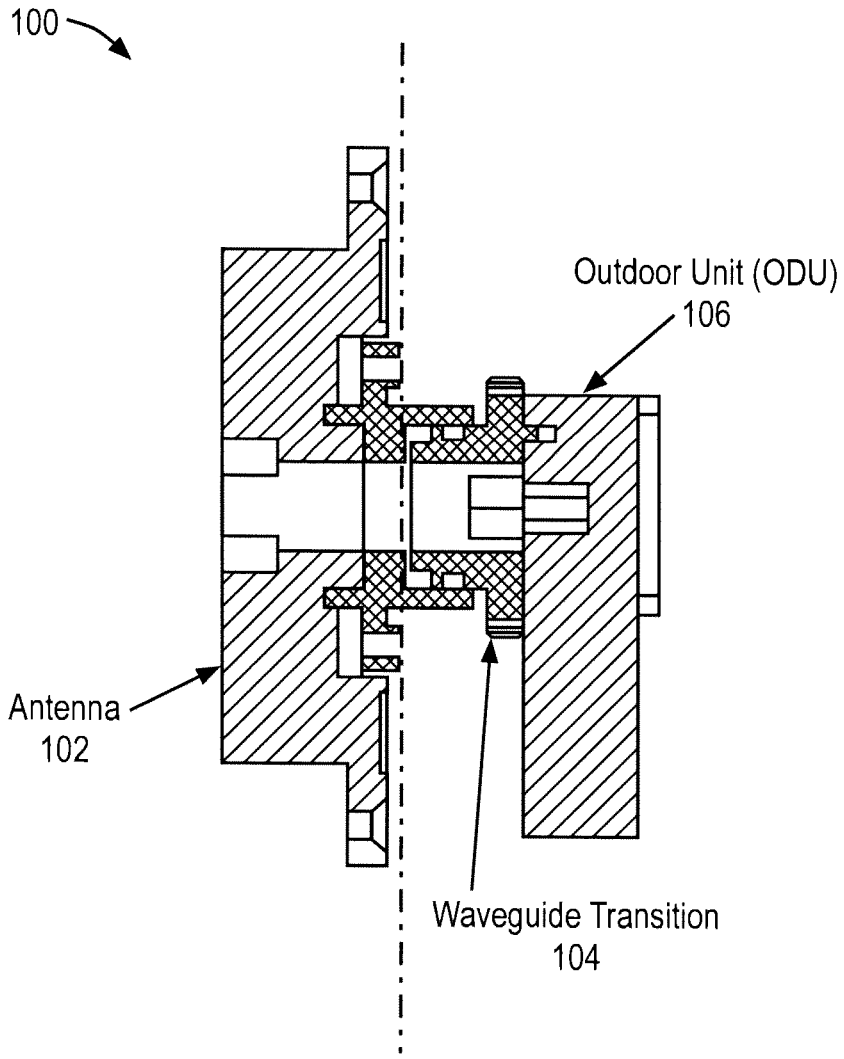
FIG. 1 is a diagram of an antenna and a radio frequency (RF) unit outdoor unit (ODU) coupled by a waveguide transition in some embodiments.

FIG. 1 is a diagram 100 of an antenna 102 and a radio frequency (RF) unit of an outdoor unit (ODU) 106 coupled by a waveguide transition 104 in some embodiments. In various embodiments, the waveguide transition 104 comprises a compact and single-section rectangular-to-circular waveguide transition. The rectangular-to-circular waveguide transition may interface with the antenna 102 via a common port with a floating choke point. The RF unit of the ODU 106 may comprise an RF diplexer.

In some embodiments, the ODU 106 is mounted to the antenna 102 either directly in a slip-fit connection using captive spring clips on the ODU 106 or remotely via a flex waveguide. The antenna 102 waveguide interface (flange) may protrude through a hole in a face plate.

With a split mount configuration, each node has an indoor unit (IDU) (not depicted in FIG. 1) and an outdoor unit (ODU) 106. The IDU may connect to a network (e.g., Ethernet or Internet networks) and the ODU 106 may be coupled to the antenna 102. In this case, the IDU comprises a power supply as well as a modem or network interface and the ODU 106 comprises an RF transceiver. The IDU may supply DC power and modulated IF signals to the ODU 106 for transmission. The IDU can receive, from the ODU 106, modulated IF signals from the antenna 102. To this end, the IDU and ODU 106 may have an up-down connection between them using coaxial cable that can carry both power and IF signals (i.e., DC and non-DC signals).

Those skilled in the art will appreciate that although a compact and single-section rectangular-to-circular waveguide transition 104 is depicted, the rectangular-to-circular waveguide transition 104 may be of any size and operate as described in at least some embodiments herein.

Figure 2:
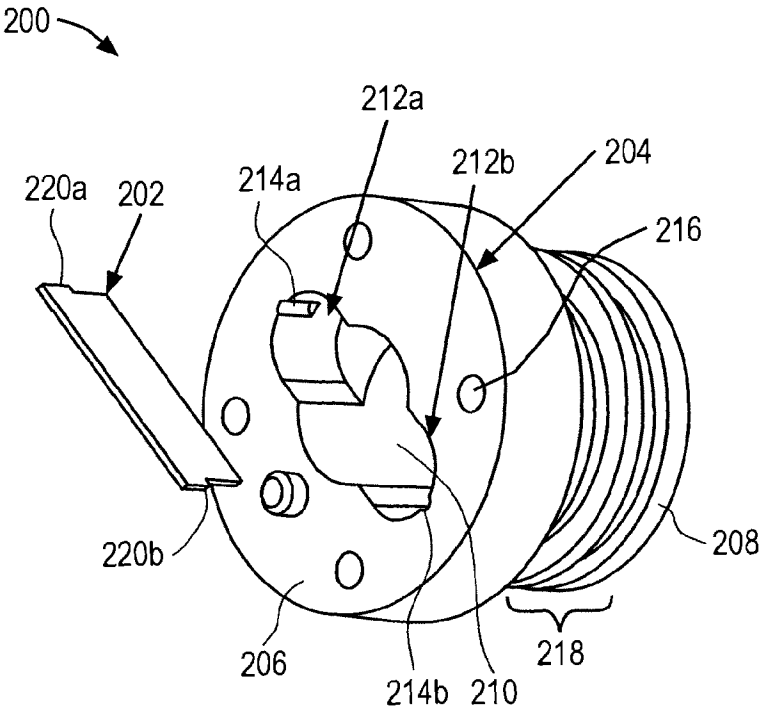
FIG. 2 is a diagram of an exemplary rectangular-to-circular waveguide transition and filter in which embodiments of the present invention may be practiced.

FIG. 2 is a diagram 200 of an exemplary rectangular-to-circular waveguide transition 204 and filter card 202 in some embodiments. The rectangular-to-circular waveguide transition 204 and filter card 202 may be the waveguide transition 104 as depicted in FIG. 1.

In various embodiments, the filter card 202 provides high-order mode suppression for the rectangular-to-circular waveguide transition 204. In one example, the rectangular-to-circular waveguide transition 204 operates in the TE10 and TE11 modes, respectively. The filter card 202 may provide high-order mode suppression for a compact waveguide transition and may offer high degrees of attenuator of other higher-order mode TE and TM signals.

The filter card 202 may be positioned in a plane parallel to TE11 modes but perpendicular to the longitudinal axis of the rectangular-to-circular waveguide transition 204. The filter card 202 may suppress higher TE and TM modes that can cause resonances and loss of energy within the signal bandwidth.

Those skilled in the art will appreciate that the rectangular-to-circular waveguide transition 204 may be compact and fit within a low profile ODU. Typical solutions in the marketplace may require either multiple section transitions or taper-structure transitions that are much longer in length (requiring a taller ODU) and/or are much more expensive.

Those skilled in the art will appreciate that by placing the filter card 202 within the recesses of the rectangular-to-circular waveguide transition 204, the filter card 202 may not impact rotational tolerance between the rectangular-to-circular waveguide transition 204 and the antenna. The filter card 202 may be a compact and low cost. The filter card 202 may provide low loss to transmission microwave energy. Further, it will be appreciated that the filter card 202 may reduce signal loss caused by resonances associated with mechanical mismatch between an antenna, a rectangular-to-circular waveguide transition 204, and/or an ODU.

The rectangular-to-circular waveguide transition 204 may comprise a front section 206 opposite a back section 208. A circular hole 210 may pass through the approximate center of the rectangular-to-circular waveguide transition 204 from the front section 206 through the back section 208. Two arcuate regions 212*a-b* are opposite each other and are adjacent to the circular hole 210. The two arcuate regions 212*a-b* individually define cavities within the front section 206. In one example, the cavities are integral with the circular hole 210. Unlike the circular hole 210, the cavities do not extend through to the back section 208.

Two recesses 214*a* and 214*b* may be defined by the arcuate regions, respectively, and be positioned opposite each other. In various embodiments, the filter card 202 may be positioned within the rectangular-to-circular waveguide transition 204 by placing edges of the filter card 202 at least partially within the recesses 214*a* and 214*b* such that the filter card 202 extends through and/or over the circular hole 210. The filter card 202 may be vertical to the circular hole 210.

The rectangular-to-circular waveguide transition 204 may comprise dowel holes 216 which may extend at least partially through the front section 206. In some embodiments, the dowel holes 216 may receive dowel pins configured to secure the rectangular-to-circular waveguide transition 204 to an antenna, mounting collar, and/or ODU.

In some embodiments, the filter card 202 comprises tabs 220 which extend partially along the edges of the filter card 202. In one example, the tabs 220*a-b* are configured to sit within the recesses 214*a* and 214*b*, respectively. The depth of the tabs 220*a-b* along the edges of the filter card 202 may define the position of the filter card 202 within the rectangular-to-circular waveguide transition 204. In various embodiments, the filter card 202 may extend in front of the front section 206 (e.g., the filter card 202 may extend outward from the rectangular-to-circular waveguide transition 204).

Those skilled in the art will appreciate that the recesses 214*a* and 214*b* may be optional. There are any number of ways to extend the filter card 202 through and/or over the circular hole 210 of the rectangular-to-circular waveguide transition 204.

The rectangular-to-circular waveguide transition 204 may also comprise coupler section 218 which may be threads or rings to allow for mounting to the antenna, mounting collar, and/or ODU. In some embodiments, one or more rubber rings (e.g., grommets) may placed between ridges of the coupler section 218 to hold the rectangular-to-circular waveguide transition 204 in pace (e.g., with the antenna, mounting collar, and/or ODU).

In various embodiments, the antenna and/or ODU may be configured such that any number of different rectangular-to-circular waveguide transitions may be coupled thereto. For example, the ODU may comprise a mounting collar that may hold a variety of different rectangular-to-circular waveguide transitions of different sizes. The antenna may comprise a flange that allows the antenna to operate with a wide variety of different rectangular-to-circular waveguide transitions of different sizes. As such, a single type of ODU may be used regardless of the frequency of the signals received by the antenna and the type of rectangular-to-circular waveguide transition used.

Figure 3A:
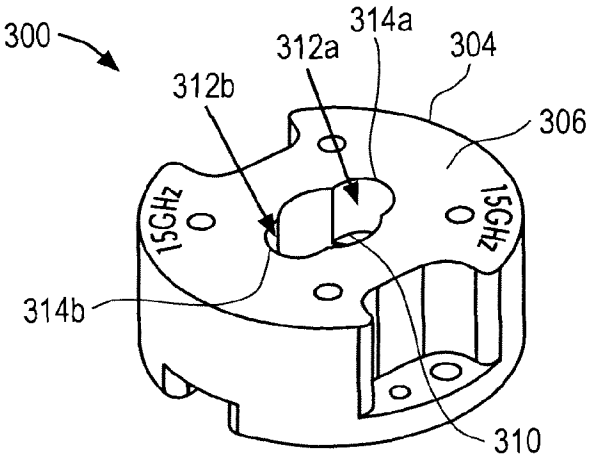
FIG. 3*a* is a diagram of a front view of a 15 GHz rectangular-to-circular waveguide transition in some embodiments.

FIG. 3*a* is a diagram of a front view 300 of a 15 GHz rectangular-to-circular waveguide transition 304 in some embodiments. Those skilled in the art will appreciate that many of the dimensions of the 15 GHz rectangular-to-circular waveguide transition 304 relate to functionality. The 15 GHz rectangular-to-circular waveguide transition 304 has a front section 306 and a back section 308 (see FIG. 3*b* and description regarding FIG. 3*b* herein). The 15 GHz rectangular-to-circular waveguide transition 304 comprises a circular hole 310 that extends through the 15 GHz rectangular-to-circular waveguide transition 304.

The 15 GHz rectangular-to-circular waveguide transition 304 further comprises two arcuate regions 312*a* and 312*b*. The arc of the first arcuate region 312*a* begins and ends with the circular region 310. Similarly, the arc of the second arcuate region 312*b* is opposite the arc of the first arcuate region 312*a* and similarly begins and ends with the circular region 310. The arcuate regions 312*a* and 312*b* each define a cavity within the 15 GHz rectangular-to-circular waveguide transition 304. The cavities may not penetrate from the front section 306 to the back section 308.

Recesses 314*a* and 314*b* may comprise grooved indentions each defined within a wall of one of the cavities. The recess 314*a* may be opposite recess 314*b*. The recesses 314*a-b* may individually include one or more edges cut into the 15 GHz rectangular-to-circular waveguide transition 304 or may be rounded. Those skilled in the art will appreciate that the recesses 314*a* and 314*b* may be shaped differently and/or be made using different processes.

The recesses 314*a-b* may be shaped and positioned such that edges of a filter card may be placed such that the filter card may be positioned to extend across, through, or partially through the circular hole 310.

The 15 GHz rectangular-to-circular waveguide transition 304 may also comprise two or more indentions along the outer portion of the transition 304 which allow for dowel holes or other coupling mechanisms to couple the 15 GHz rectangular-to-circular waveguide transition 304 to the antenna, mounting collar, and/or ODU.

Figure 3B:
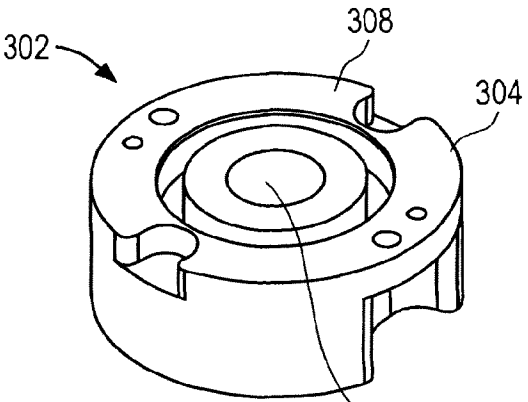
FIG. 3*b* is a diagram of a back view of the 15 GHz rectangular-to-circular waveguide transition in some embodiments.

FIG. 3*b* is a diagram of a back view 302 of the 15 GHz rectangular-to-circular waveguide transition 304 in some embodiments. The back view 302 depicts the back section 308 of the 15 GHz rectangular-to-circular waveguide transition 304 as well as the circular hole 310 that extends through the front section 306 depicted in FIG. 3*a*.

Figure 3C:
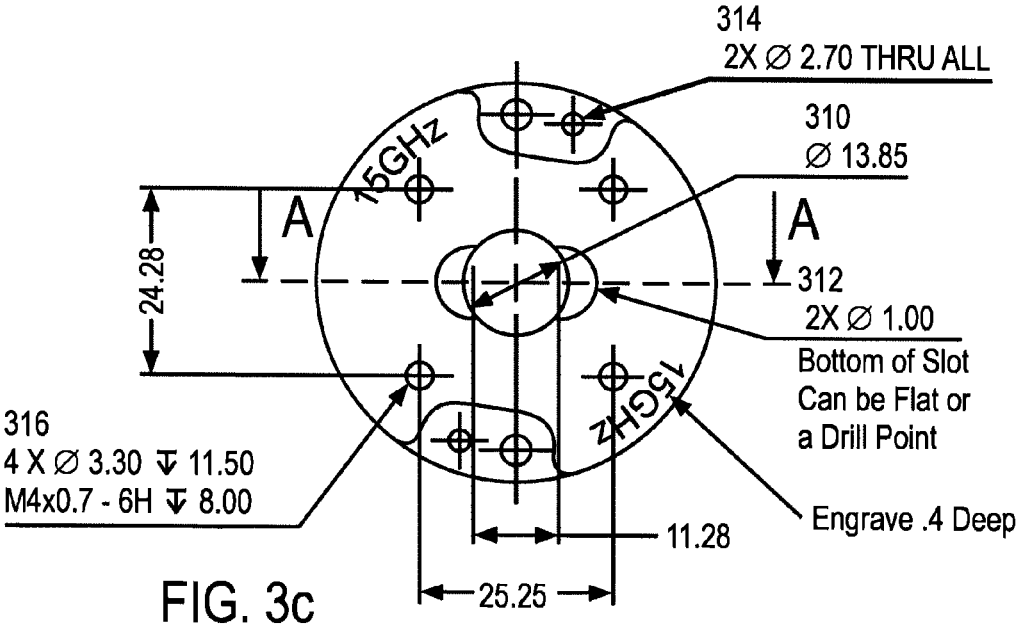
FIG. 3*c* is another diagram of a front view of the 15 GHz rectangular-to-circular waveguide transition in some embodiments.

FIG. 3*c* is another diagram of a front view of the 15 GHz rectangular-to-circular waveguide transition 304 in some embodiments. FIG. 3*c* includes some measurements of some of the different physical characteristics of the 15 GHz rectangular-to-circular waveguide transition 304. The physical characteristics of the 15 GHz rectangular-to-circular waveguide transition 304 may be of any shape or size and still fulfill at least some of the functions of the 15 GHz rectangular-to-circular waveguide transition 304.

Figure 3D:
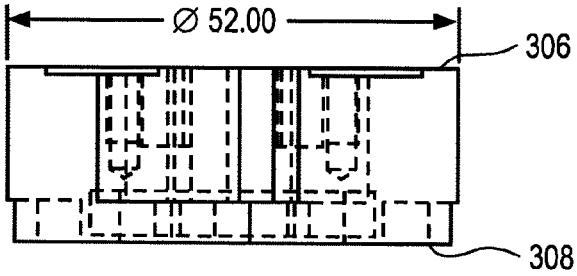
FIG. 3*d* is a diagram of a side view of the 15 GHz rectangular-to-circular waveguide transition in some embodiments.

In various embodiments, the front section 306 of the 15 GHz rectangular-to-circular waveguide transition 304 may be 52 mm in diameter (see FIG. 3*d*). The circular hole 310 may be 13.85 mm in diameter. The apex of each arcuate region 312 may be 1 mm from the edge of the circular hole 310. The smaller of the dowel holes 314 in the arcuate region may penetrate through the back section 308 and may be 2.7 mm in diameter. Each of the four dowel holes 316 in the front section 306 may be 3.3 mm in diameter.

FIG. 3*d* is a diagram of a side view of the 15 GHz rectangular-to-circular waveguide transition 304 in some embodiments. As discussed herein, the 15 GHz rectangular-to-circular waveguide transition 304 may be 52 mm in diameter. The side view of the 15 GHz rectangular-to-circular waveguide transition 304 depicts internal structures as dashed lines. For example, dowel holes are shown extending from the front section 306 but not through to the back section 308. The cavities defined by the arcuate regions 312*a* and *b* within the body of the 15 GHz rectangular-to-circular waveguide transition 304 may each be flat at their base within the 15 GHz rectangular-to-circular waveguide transition 304, may end in drill point, may be rounded, or may be any other shape.

Figure 3E:
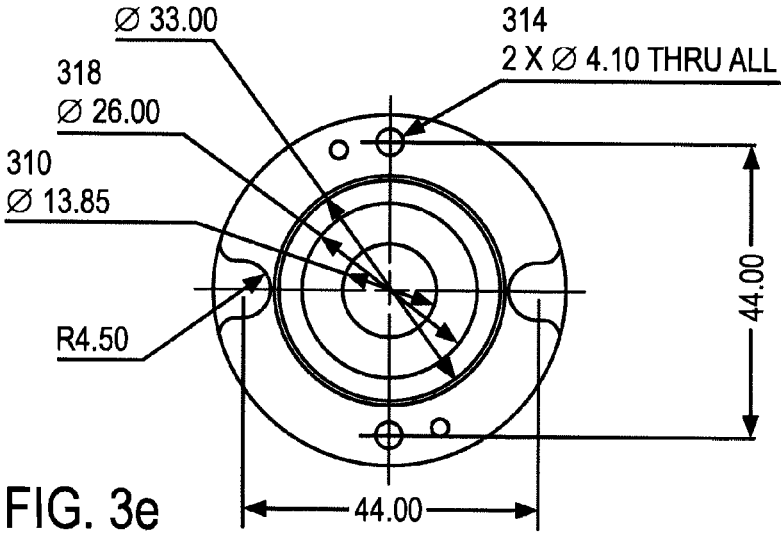
FIG. 3*e* is another diagram of a back view of the 15 GHz rectangular-to-circular waveguide transition in some embodiments.

FIG. 3*e* is another diagram of a back view of the 15 GHz rectangular-to-circular waveguide transition in some embodiments. As depicted in FIG. 3*c*, the circular hole 310 is 13.85 mm in diameter. The larger of the dowel holes 314 is 4.10 mm in diameter and may pass through the indention from the back section 308.

In various embodiments, the back section 308 may comprise an inner ring 318 around the circular hole 310. The inner ring 318 may begin at 26 mm in diameter around the circular hole 310 and may end at 33 mm in diameter around the circular hole 310. The distance from a center of a first dowel hole 314*b* to a center of a second dowel hole 314*b* opposite the first dowel hole 314*b* is 44 mm.

The dimensions identified in FIGS. 3*c-e* are in millimeters. Those skilled in the art will appreciate that the dimensions of the 15 GHz rectangular-to-circular waveguide transition 304 depicted in FIGS. 3*c-e* may be approximate. Further, in some embodiments, the dimensions may be modified but still function as a rectangular-to-circular waveguide transition operable with a signal at 15 GHz or other frequenc(ies).

The 15 GHz rectangular-to-circular waveguide transition 304 may comprise aluminum such as, for example, an aluminum alloy. In one example, the 15 GHz rectangular-to-circular waveguide transition 304 comprises 6061 aluminum alloy. Those skilled in the art will appreciate that the 15 GHz rectangular-to-circular waveguide transition 304 may comprise one or more different materials.

Figure 4A:
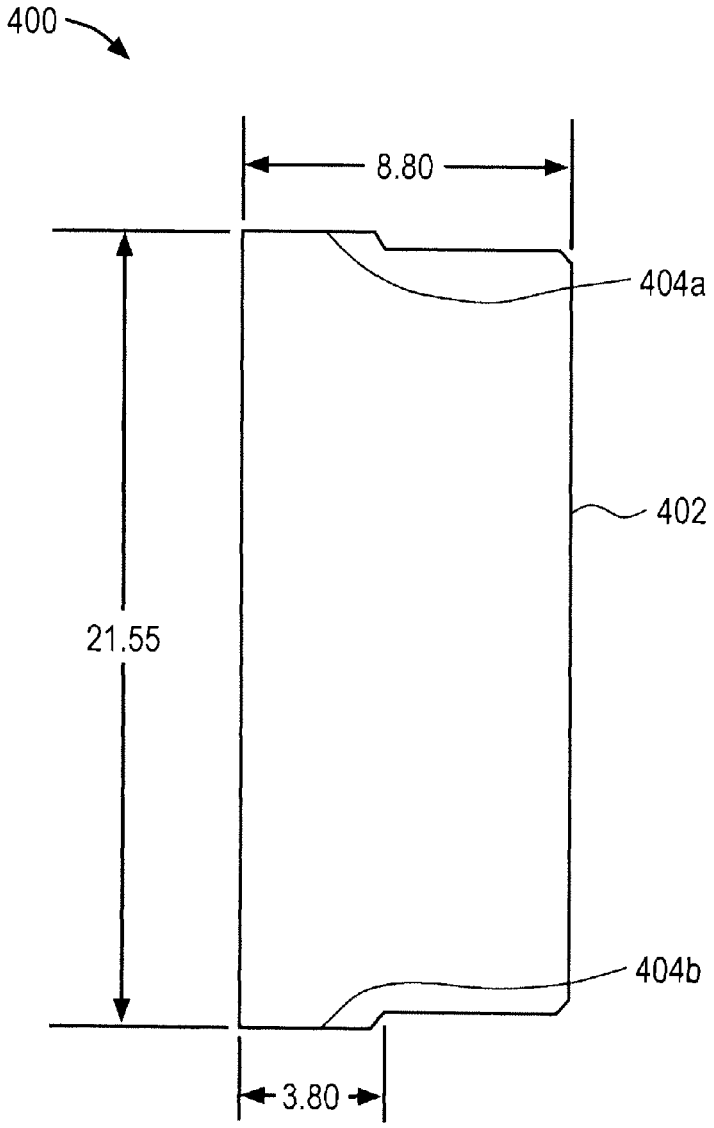
FIG. 4*a* is a diagram of a front view of a filter card that may be used with the 15 GHz rectangular-to-circular waveguide transition in some embodiments.

FIG. 4*a* is a diagram of a front view 400 of a filter card 402 that may be used with the 15 GHz rectangular-to-circular waveguide transition 304 in some embodiments. In various embodiments, the filter card 402 may comprise tabs 404*a* and 404*b*. The tabs 404*a* and 404*b* may allow the filter card to sit in position within the rectangular-to-circular waveguide transition 304. In some embodiments, the filter card 402 is 21.55 mm long measured from tab 404*a* to tab 404*b* as depicted in FIG. 4*a*. The filter card 402 may be 8.80 mm wide. Tabs 404*a* and 404*b* may extend 3.8 mm along the outer edges of the filter card 402 extending from one of the edges of the filter card 402. Those skilled in the art will appreciate that the filter card 402 may be of any size or shape depending upon the distance between the recesses of the rectangular-to-circular waveguide transition 304 and/or the frequency of the signal to be filtered.

The filter card 402 may comprise any resistive material. In one example, the filter card 402 comprises a fiberglass metal film. In various embodiments, the filter card 402 comprises a stable microwave attenuator material. The substrate of the filter card 402 may be a fine-woven glass cloth impregnated with high temperature thermosetting resin. The resin may be procured to MIL-I-24768 DES G-11. A resistance film of nickel chromium alloy may be deposited uniformly on the substrate service. Further, a clear protective coating may be applied over the resistance film.

The filter card 402 may be usable at a variety of different frequencies including up to 18 GHz, 38 GHz, or more. In some embodiments, the filter card 402 may be use for applications requiring accurate crystal detector protection, mode suppression in cavity filters, waveguide attenuation, termination elements, narrow bank stripline loads, and/or attenuators.

In some embodiments, the filter card 402 may have a resistance surface of 50 to 400 Ohms per square. Nominal power may be one Watt per square inch at 80 C ambient handling capacity. The dielectric constant of the filter card 402 may be 4.8 typical at 1 MHz. The temperature cycling of the filter card 402 may be rated to Mil-Std-202 method 102 Cond. C (−65 C to +125 C). The moisture resistance may be rated to Mil-Std-202, method 106 less step 7b. The fiberglass material may be rated per Mil-I-247848 Type DES G-11. The finish may be a nichrome resistive film.

In one example, the filter card 402 may be manufactured by fabricating a glass cloth impregnated with high temperature thermosetting resin. A resistance film of nickel chromium alloy may be deposited on the impregnated glass cloth. A clear protective coating may subsequently be applied over the resistance film.

Once the filter card 402 is manufactured, the filter card 402 may be installed within a rectangular-to-circular waveguide transition. For example, the filter card 402 may be inserted within recesses positioned in cavities located on the face of the rectangular-to-circular waveguide transition. The filter card 402 may be positioned horizontally along and/or in front of a long axis of the circular hole of the rectangular-to-circular waveguide transition. Tabs 404*a* and 404*b* on the filter card 402 may fit within the recesses thereby allowing the filter card 402 to be positioned at a predetermined depth within the rectangular-to-circular waveguide transition. In some embodiments, epoxy may be applied to the tabs 404*a* and/or 404*b* to secure the filter card 402 to the rectangular-to-circular waveguide transition.

The rectangular-to-circular waveguide transition with the filter card 402 may be coupled to the antenna and/or ODU. In some embodiments, the antenna comprises a circular waveguide. The circular waveguide of the antenna may be coupled to the rectangular-to-circular waveguide transition (e.g., via a choke flange). The rectangular-to-circular waveguide transition may also be coupled to an ODU and/or a RF diplexer. In some embodiments, the ODU and/or RF diplexer comprises a mounting collar which secures the position of the rectangular-to-circular waveguide transition. The mounting collar may allow a wide variety of different rectangular-to-circular waveguide transitions (e.g., for different frequencies or to change damaged components) to be secured to the ODU and/or RF diplexer.

In some embodiments, wave energy (e.g., signals) may be received by the rectangular-to-circular waveguide transition via the antenna. The filter card 402 of the rectangular-to-circular waveguide transition may filter the wave energy to attenuate undesired modes. The attenuation may reduce reflection and/or resonance thereby preserving the energy of the wave. The attenuation may also reduce reflections and/or resonances caused by mechanical mismatch between the antenna and the rectangular-to-circular waveguide transition as well as reflections and/or resonances caused by mechanical mismatch between the rectangular-to-circular waveguide transition and the ODU and/or RF diplexer. The filter card 402 may filter the wave energy to perform crystal detector protection.

Figure 4B:
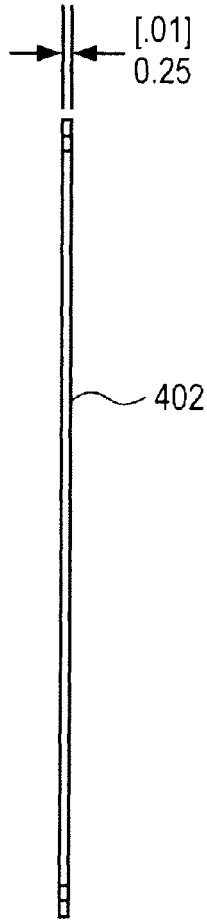
FIG. 4*b* is a diagram of a side view of a filter card that may be used with the 15 GHz rectangular-to-circular waveguide transition in some embodiments.

FIG. 4*b* is a diagram of a side view of a filter card 402 that may be used with the 15 GHz rectangular-to-circular waveguide transition 304 in some embodiments. The filter card 402 may be 0.25 mm thick. As discussed regarding FIG. 4*a*, those skilled in the art will appreciate that the filter card 202 may be of any thickness depending upon the size of the recesses of the rectangular-to-circular waveguide transition 304 and/or the frequency of the signal to be filtered.

Figure 5:
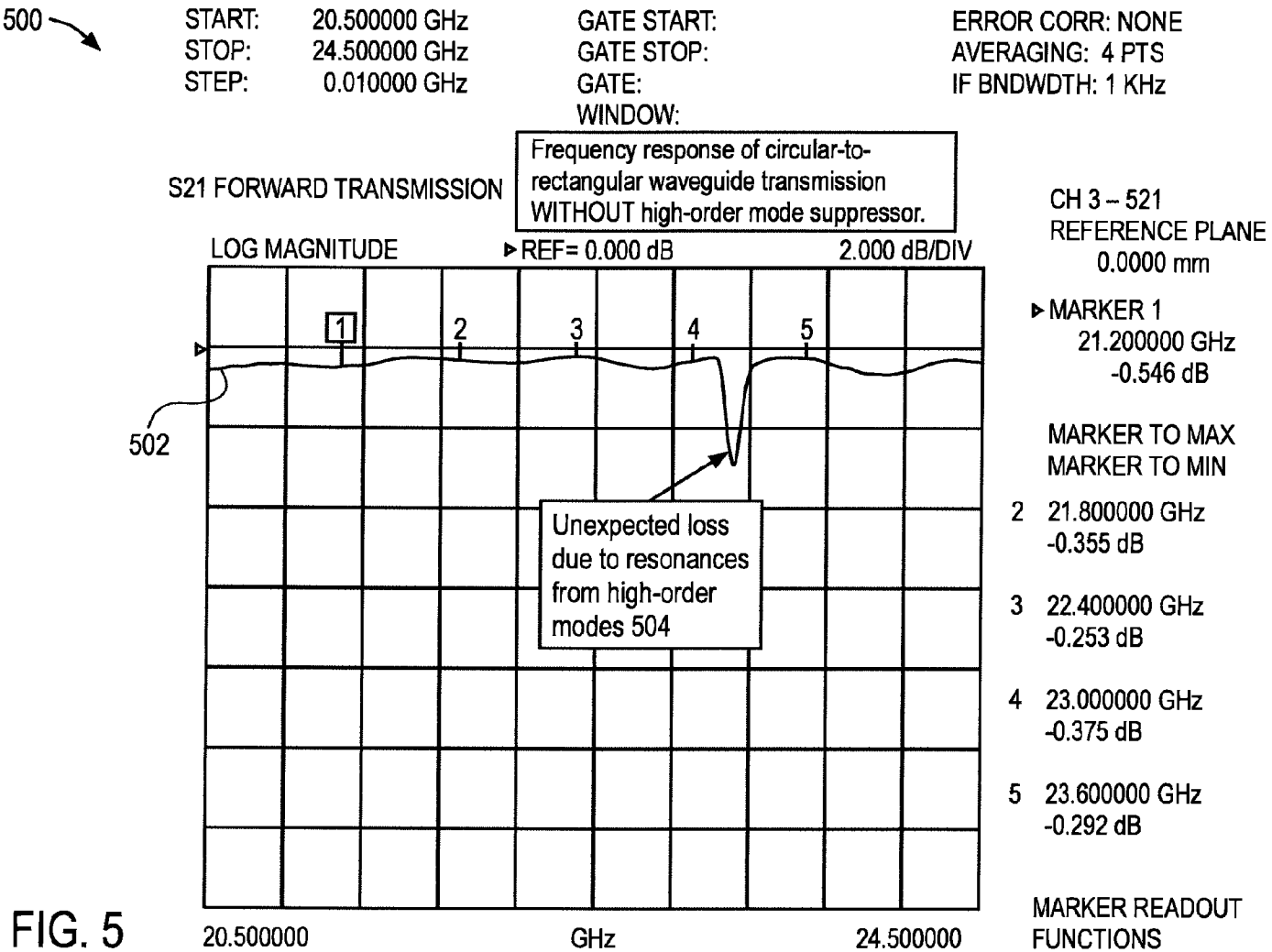
FIG. 5 is a graph of a frequency response of a rectangular-to-circular waveguide transition without a filter.

FIG. 5 is a graph 500 of a frequency response 502 of a rectangular-to-circular waveguide transition without a filter card. As discussed herein, one problem associated with circular waveguides is that while the waveguide traditionally efficiently transmits a TE11 signal with very low loss, the waveguide may also support many high-order modes such as TE01, TE21, TE31, TE41, TM01, TM02, TM11, TM31, etc. These higher-order modes can cause resonances depending upon length of the circular waveguide or slight rotation of the waveguide transition. These resonances may create unexpected loss of the microwave signal.

As shown in the graph 500, the frequency response 502 of the rectangular-to-circular waveguide transition without a filter card is steady until loss appears at point 504 between 23 GHz to 23.6 GHz. This loss is due to resonances from high-order modes.

Figure 6:
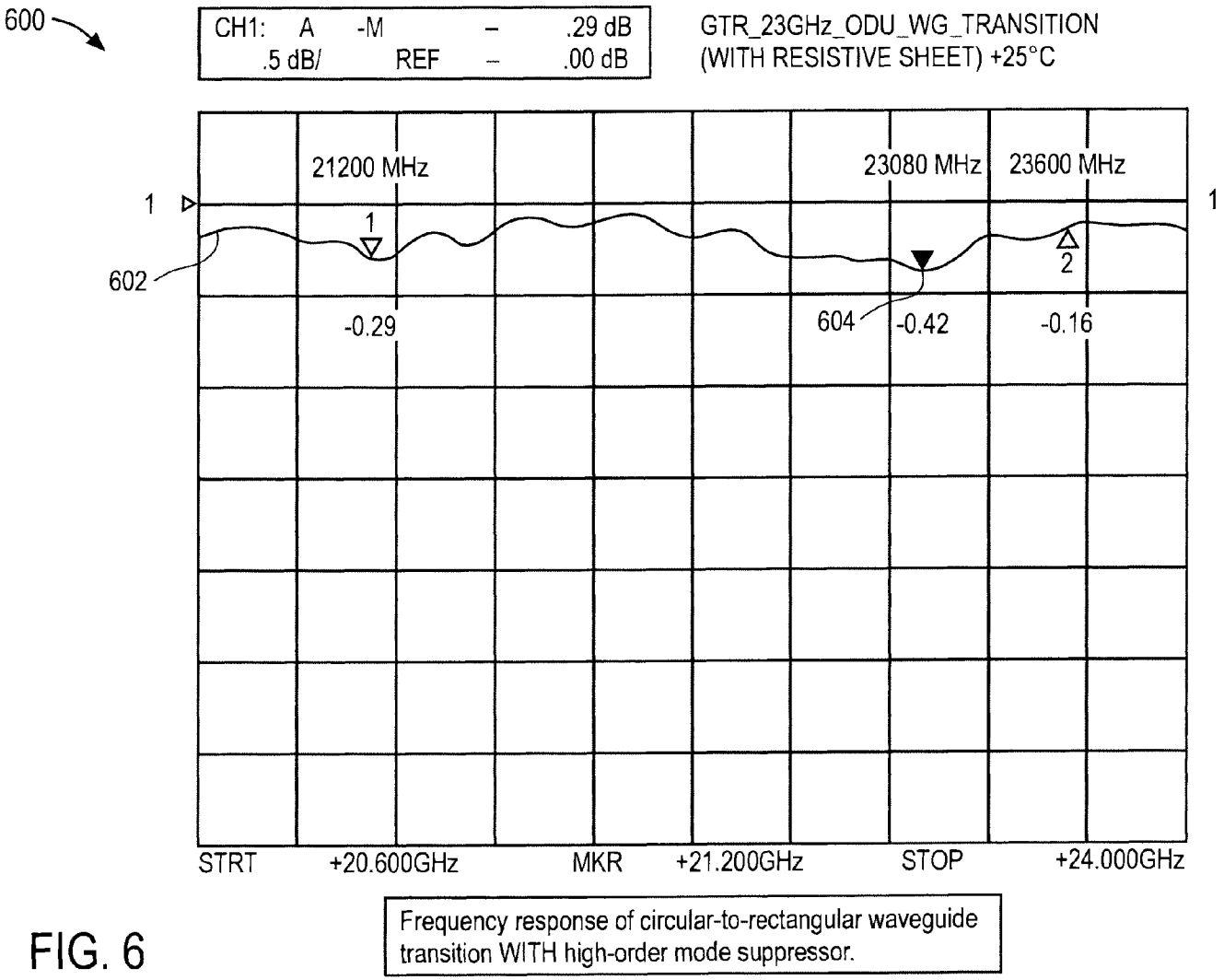
FIG. 6 is a graph of a frequency response of a rectangular-to-circular waveguide transition with a filter in some embodiments.

FIG. 6 is a graph 600 of a frequency response 602 of a rectangular-to-circular waveguide transition with a filter card in some embodiments. In various embodiments, undesired TE and TM modes are absorbed and dissipated by the filter card. For example, the frequency response 602 of the rectangular-to-circular waveguide transition with a filter card depicted in graph 600 is steady. Further, the frequency response 602 shows that there is not a spike of loss at point 604 (which corresponds in frequency to the point 504 in graph 500 of FIG. 5) due to resonances from high-order modes as there is in graph 500.

Further, those skilled in the art will appreciate that the rectangular-to-circular waveguide transition with the filter card may allow for greater rotational tolerance between mounting circular waveguides. As a result, there is a greater tolerance for mechanical mismatch.

Figure 7B:
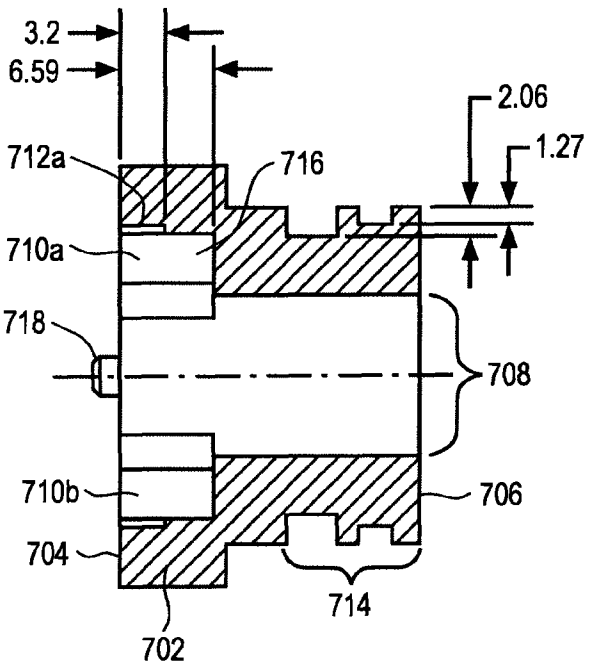
FIG. 7*b* is a diagram of a left side view of the 18 GHz rectangular-to-circular waveguide transition in some embodiments.
Figure 7A:
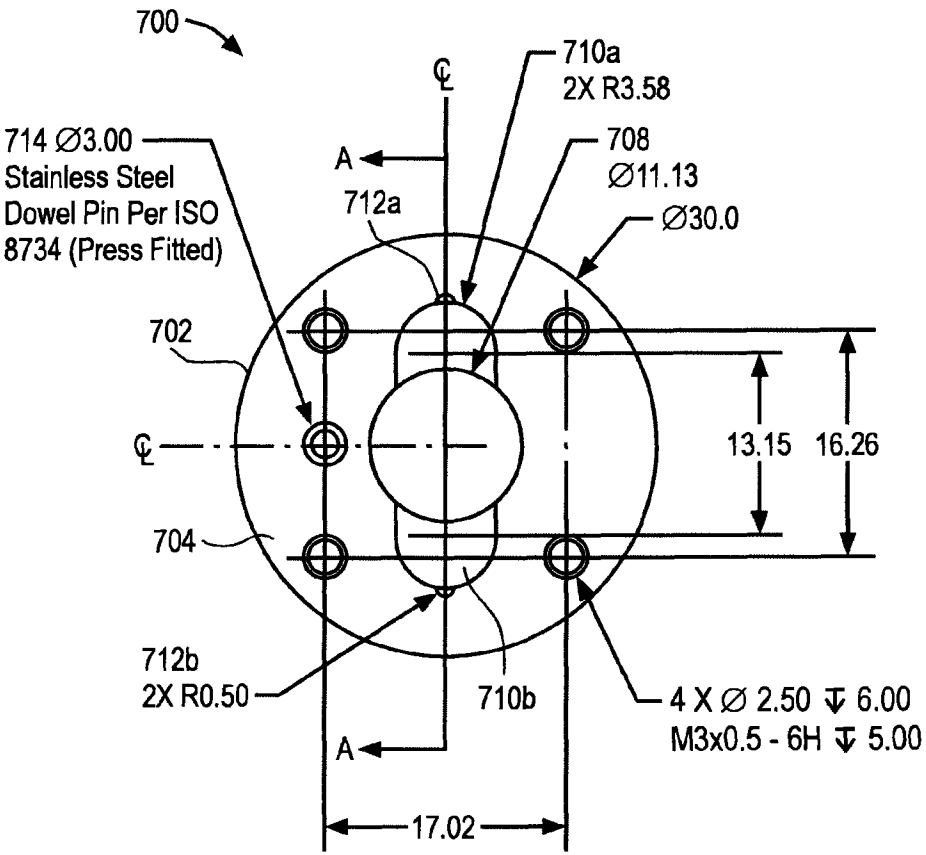
FIG. 7*a* is a diagram of a front view of an 18 GHz rectangular-to-circular waveguide transition in some embodiments.

FIG. 7*a* is a diagram of a front view 700 of an 18 GHz rectangular-to-circular waveguide transition 702 in some embodiments. Similar to the 15 GHz rectangular-to-circular waveguide transition 304, the 18 GHz rectangular-to-circular waveguide transition 702 may comprise a front section 704 and a back section 706 opposite the front section 704. The 18 GHz rectangular-to-circular waveguide transition 702 further comprises a circular hole 708 with arcuate regions 710*a* and 710*b* integral with the circular hole 708. The arcuate regions 710*a* and 710*b* are opposite each other across the circular hole 708. The arcuate regions 710*a* and 710*b* each define individual cavities within the 18 GHz rectangular-to-circular waveguide transition 702. Within the arcuate region 710*a* and within the cavity, a recess 712*a* is defined. Similarly, within the arcuate region 710*b* and within the cavity, a recess 712*b* is defined. The 18 GHz rectangular-to-circular waveguide transition 702 may further comprise any number of dowel holes to receive dowel pins for coupling the 18 GHz rectangular-to-circular waveguide transition 702 to an antenna, mounting collar, and/or ODU.

FIG. 7*a* includes some measurements of some of the different characteristics of the 18 GHz rectangular-to-circular waveguide transition 702. The physical characteristics of the 18 GHz rectangular-to-circular waveguide transition 702 may be of any shape and still fulfill at least some of the functions of the 18 GHz rectangular-to-circular waveguide transition 702.

In various embodiments, the front section 704 of the 18 GHz rectangular-to-circular waveguide transition 702 may be 30 mm in diameter. The circular hole 708 may be 11.13 mm in diameter. The apex of each arcuate regions 710*a* and 710*b* may each be 3.58 mm from the edge of the circular hole 708. The recesses 712*a* and 712*b* may each be 0.5 mm in depth. Each of the four dowel holes in the front section 704 may be 3.3 mm in diameter. Each of the dowel holes may be 16.26 mm from another.

FIG. 7*b* is a diagram of a left side view of the 18 GHz rectangular-to-circular waveguide transition 702 in some embodiments. The left side view of the 18 GHz rectangular-to-circular waveguide transition 702 depicts the front section 704 opposite the back section 706. The circular hole 708 extends through the 18 GHz rectangular-to-circular waveguide transition 702 from the front section 704 to the back section 706. The first and second arcuate regions 710*a* and 710*b* define the cavities that extend from the front section 704 to a point within the 18 GHz rectangular-to-circular waveguide transition 702. FIG. 7*b* depicts the depth of each cavity to be 6.59 mm from the front section 704. Recesses 712*a* and 712*b* are defined within the arcuate sections 710*a* and 710*b* within the cavities. The recesses 712*a* and 712*b* may each extend 3.2 mm from the front section 704 adjacent to the cavities towards the back section 706. Coupler section 714 may be threaded or with rings for coupling the 18 GHz rectangular-to-circular waveguide transition 702 to an antenna, a mounting collar, and/or an ODU.

Figure 7D:
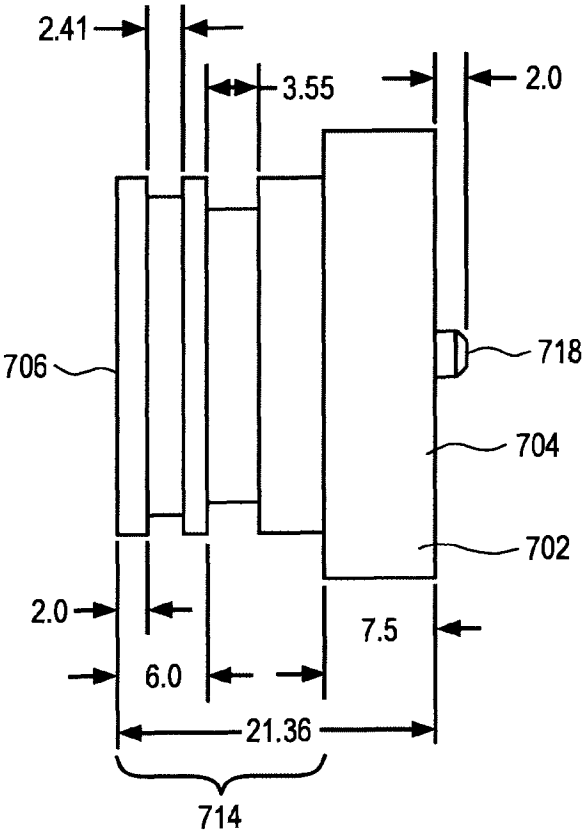
FIG. 7*d* is a diagram of a right side view of the 18 GHz rectangular-to-circular waveguide transition in some embodiments.
Figure 7C:
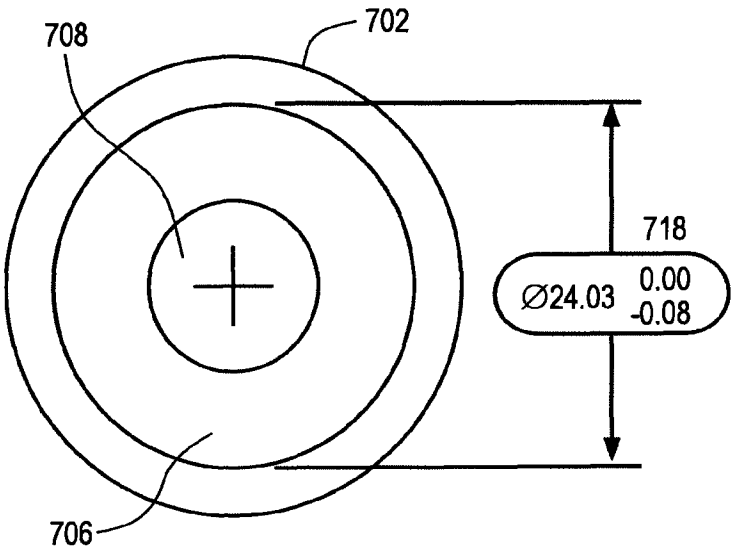
FIG. 7*c* is another diagram of a back view of the 18 GHz rectangular-to-circular waveguide transition in some embodiments.

FIG. 7*c* is another diagram of a back view of the 18 GHz rectangular-to-circular waveguide transition 702 in some embodiments. As depicted in FIG. 3*c*, the circular hole 708 extends from the front section 704 to the back section 706 of the 18 GHz rectangular-to-circular waveguide transition 702.

FIG. 7*d* is a diagram of a right side view of the 18 GHz rectangular-to-circular waveguide transition 702 in some embodiments. FIG. 7*d* depicts the GHz rectangular-to-circular waveguide transition 702 as being 21.36 mm wide from the front section 704 to the back section 706. The GHz rectangular-to-circular waveguide transition 702 may also comprise a pin 718 for positioning the GHz rectangular-to-circular waveguide transition 702 relative to the antenna, mounting collar, and/or an ODU.

The dimensions identified in FIGS. 7*a-d* are in millimeters. Those skilled in the art will appreciate that the dimensions of the GHz rectangular-to-circular waveguide transition 702 depicted in FIGS. 7*a-d* may be approximate. Further, in some embodiments, the dimensions may be modified but still function as a rectangular-to-circular waveguide transition operable with a signal at 18 GHz or other frequenc(ies).

The 18 GHz rectangular-to-circular waveguide transition 702 may comprise aluminum such as, for example, an aluminum alloy. In one example, the 18 GHz rectangular-to-circular waveguide transition 702 comprises 6061-T6 aluminum alloy. Those skilled in the art will appreciate that the 18 GHz rectangular-to-circular waveguide transition 702 may comprise one or more different materials.

Figure 8B:
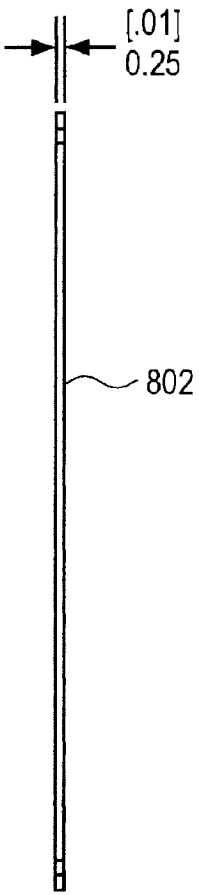
FIG. 8*b* is a diagram of a side view of a filter card that may be used in the 18 GHz rectangular-to-circular waveguide transition in some embodiments.
Figure 8A:
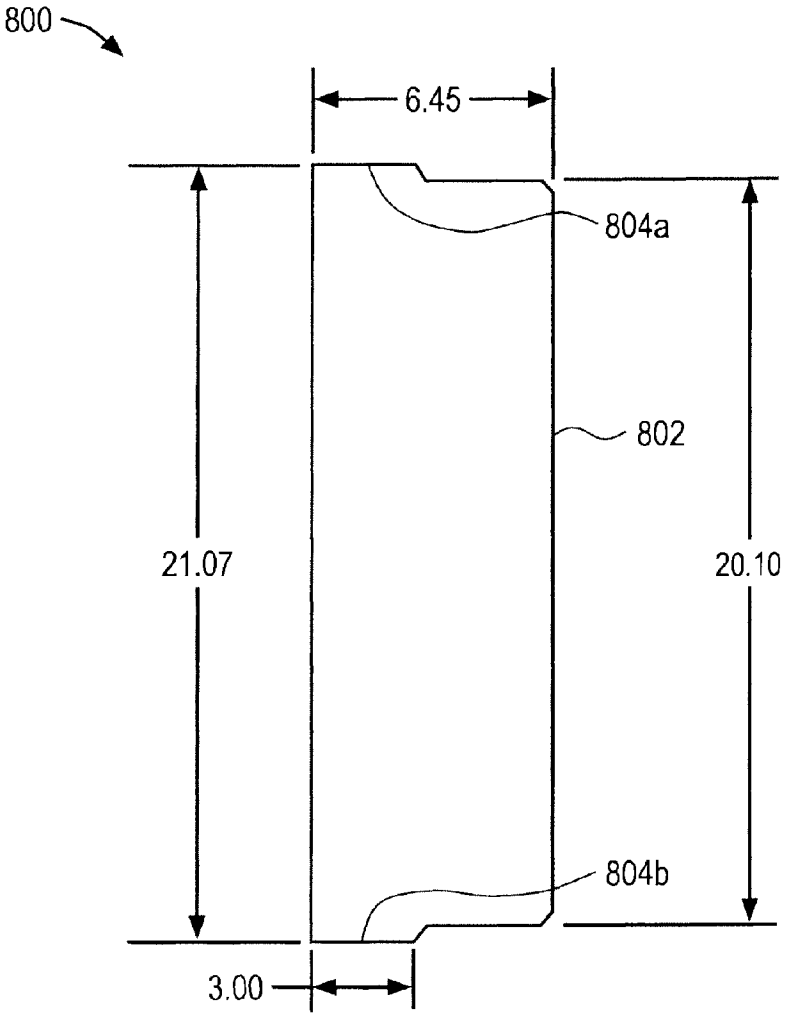
FIG. 8*a* is a diagram of a front view of a filter card that may be used in the 18 GHz rectangular-to-circular waveguide transition in some embodiments.

FIG. 8*a* is a diagram of a front view 800 of a filter card 802 that may be used in the 18 GHz rectangular-to-circular waveguide transition 702 in some embodiments. The filter card 802 may be 21.07 mm wide including tabs 804*a* and 804*b*. The tabs 804*a* and 804*b* may be each 0.485 mm wide and 3.00 mm long extending from an edge of the filter card 802. As follows, not including the tabs 804*a* and 804*b*, the filter card 802 is 20.10 mm wide.

As discussed herein, the filter card 802 may be configured such that the filter card 802 fits within the recesses 712*a* and 712*b* of the 18 GHz rectangular-to-circular waveguide transition 702. The tabs 804*a* and 804*b* may sit on the bottom of the recesses 712*a* and 712*b* thereby positioning the filter card 802.

FIG. 8*b* is a diagram of a side view of the card filter 802 that may be used in the 18 GHz rectangular-to-circular waveguide transition 702 in some embodiments. The filter card 802 may be 0.25 mm thick. As discussed regarding FIG. 4*a*, those skilled in the art will appreciate that the filter card 802 may be of any thickness depending upon the size of the recesses of the 18 GHz rectangular-to-circular waveguide transition 702 and/or the frequency of the signal to be filtered.

The present invention is described above with reference to exemplary embodiments. It will be apparent to those skilled in the art that various modifications may be made and other embodiments can be used without departing from the broader scope of the present invention. Therefore, these and other variations upon the exemplary embodiments are intended to be covered by the present invention.

The invention claimed is:

1. A system comprising:

a rectangular-to-circular waveguide transition comprising a front section and a back section, the rectangular-to-circular waveguide transition defining a hole having a substantially circular cross section and extending through the front section and the back section, the rectangular-to-circular waveguide transition further defining a first cavity extending at least partially through the front section and integrating with the hole and not extending through the back section, the rectangular-to-circular waveguide transition also defining a second cavity opposite the first cavity, the second cavity extending at least partially through the front section and integrating with the hole and not extending through the back section; and a filter card configured to be placed across the first cavity, the hole, and the second cavity.

2. The system of claim 1, wherein the filter card extends vertically across the circular hole of the rectangular-to-circular waveguide transition.

3. The system of claim 1, wherein the rectangular-to-circular waveguide transition further defines a first recess within the first cavity and a second recess within the second cavity.

4. The system of claim 3, wherein the filter card has a first edge and a second edge, and the filter card comprises tabs along the first edge and the second edge, the tabs limiting a position within the recesses.

5. The system of claim 3, wherein the filter card has a first edge and a second edge, and the first recess and the second recess are configured to receive the first edge and the second edge of the filter card to position the filter card across the circular hole.

6. The system of claim 1, wherein the filter card comprises a substrate of woven glass cloth impregnated with thermosetting resin.

7. The system of claim 1, wherein the filter card comprises a resistance film comprising a nickel chromium alloy.

8. The system of claim 1, wherein the filter card attenuates at least some wave energy.

9. The system of claim 1, further comprising an antenna and an outdoor unit (ODU) whereby signals from the antenna are received by the ODU via the rectangular-to-circular waveguide transition.

10. A method comprising:

receiving, by a rectangular-to-circular waveguide transition, wave energy from an antenna, the rectangular-to-circular waveguide transition including a front section and a back section, the rectangular-to-circular waveguide transition defining a hole having a substantially circular cross section and extending through the front section and the back section, the rectangular-to-circular waveguide transition further defining a first cavity extending at least partially through the front section and integrating with the hole and not extending through the back section, the rectangular-to-circular waveguide transition also defining a second cavity opposite the first cavity, the second cavity extending at least partially through the front section and integrating with the hole and not extending through the back section; and filtering the wave energy from the antenna with a filter card configured to be placed across the first cavity, the hole, and the second cavity.

11. The method of claim 10, wherein the filter card extends vertically across the circular hole of the rectangular-to-circular waveguide transition.

12. The method of claim 10, wherein the rectangular-to-circular waveguide transition further defines a first recess within the first cavity and a second recess within the second cavity.

13. The method of claim 12, wherein the filter card has a first edge and a second edge, and the filter card comprises tabs along the first edge and the second edge, the tabs limiting a position within the recesses.

14. The method of claim 12, wherein the filter card has a first edge and a second edge, and the first recess and the second recess are configured to receive the first edge and the second edge of the filter card to position the filter card across the circular hole.

15. The method of claim 10, wherein the filter card comprises a substrate of woven glass cloth impregnated with thermosetting resin.

16. The method of claim 10, wherein the filter card comprises a resistance film comprising a nickel chromium alloy.

17. The method of claim 10, further comprising an antenna and an outdoor unit (ODU) whereby signals from the antenna are received by the ODU via the rectangular-to-circular waveguide transition.

18. A system comprising:

a rectangular-to-circular waveguide transition including a front section and a back section, the rectangular-to-circular waveguide transition defining a hole having a substantially circular cross section and extending through the front section and the back section, the rectangular-to-circular waveguide transition further defining a first cavity extending at least partially through the front section and integrating with the hole and not extending through the back section, the rectangular-to-circular waveguide transition also defining a second cavity opposite the first cavity, the second cavity extending at least partially through the front section and integrating with the hole and not extending through the back section; and a filtering means for filtering wave energy, the filtering means configured to be placed across the first cavity, the hole, and the second cavity.

* * * * *